US006483411B2

(12) United States Patent
Chiang et al.

(10) Patent No.: US 6,483,411 B2
(45) Date of Patent: Nov. 19, 2002

(54) TRANSFORMER

(75) Inventors: Shen-Long Chiang, Taipei (TW); Chin-Chu Huang, Taipei (TW); Ching-Fu Hsueh, Taoyuan (TW)

(73) Assignee: Darfon Electronics Corp., Taoyuan (TW)

( * ) Notice: Subject to any disclaimer, the term of this patent is extended or adjusted under 35 U.S.C. 154(b) by 0 days.

(21) Appl. No.: 09/783,010

(22) Filed: Feb. 15, 2001

(65) Prior Publication Data

US 2001/0035807 A1 Nov. 1, 2001

(30) Foreign Application Priority Data

Apr. 27, 2000 (TW) ..... 089108056

(51) Int. Cl.[7] ..... H01F 27/24; H01F 27/30

(52) U.S. Cl. ..... 336/182; 336/212; 336/198; 336/192; 29/605

(58) Field of Search ..... 336/198, 208, 336/192, 200, 96, 212, 182, 65; 29/605

(56) References Cited

U.S. PATENT DOCUMENTS 5,760,670 A * 6/1998 Yeh et al. ..... 336/134
5,761,670 A * 6/1998 Joy ..... 707/103

FOREIGN PATENT DOCUMENTS

JP 04245607 A * 9/1992 ..... 336/65

* cited by examiner

*Primary Examiner*—Anh Mai
(74) *Attorney, Agent, or Firm*—Rabin & Berdo, P.C.

(57) ABSTRACT

A transformer includes a bobbin, an I-bar, the first U-core, and the second U-core. The bobbin in a tube shape is wrapped around by a number of windings of copper coil. An I-bar made of high permeable alloy has a first end and a second end. The I-bar is inserted into the bobbin and the first end and the second end of the I-bar protrude outside the tube of the bobbin respectively. A first U-core made of high permeable alloy is placed on one side of the bobbin and a second U-core made of high permeable alloy is placed on the other side of the bobbin. The two ends of the first U-core and the second U-core connect the I-bar through the films and the sunken parts of the first U-core and the second U-core are in opposition to each other.

12 Claims, 5 Drawing Sheets

TRANSFORMER

BACKGROUND OF THE INVENTION

This application incorporates by reference Taiwanese application Serial No. 89108056, Filed Apr. 27, 2000.

1. Field of the Invention

The invention relates in general to a transformer, and more particularly to a transformer for Liquid Crystal Display (LCD).

2. Description of the Related Art

The transformer plays an important role among various hi-tech electronic products. For example, it requires a small size transformer to energize the Cold Cathode Fluorescent Lighting (CCFL) for operating properly.

Referring to FIGS. 1A–1C, a top view, lateral view, and decomposed diagram of a conventional transformer for LCD is shown. The transformer 100 includes a U-core 102, an I-bar 106, and a bobbin 104. The U-core 102 includes inverted U-shaped bridges 108A and 108B and oblong-shaped sides 110A and 111B. The top view of the U-core 102 is a hollow rectangle and the U-core 102 is made of a high permeable material. The bobbin 104 is made of a high-voltage endurable plastic material and capable of winding the copper coil 112. The bobbin 104 further includes a number of pins 114A and 114B fixed in the Printed Circuit Board (not shown in FIGS). The I-bar 106 is a flat rectangular solid and made of high permeable material.

The stepwise sequence for assembling the transformer involves first winding the bobbin 104 with the copper coil 112 and twining the terminals of the copper coil 112 round the pins 114A and 114B for fastening. The I-bar 106 is then put into the hollow sleeve 116 of the bobbin 104 and the U-core 102 is mounted on the bobbin 104. After fixing the U-core 102, I-bar 106, and bobbin 104 together by the epoxy 118, the transformer 100 as shown in FIG. 1A is finished.

The process of producing a U-core 102 includes the following steps: a mold is first opened for the U-core 102 wherein the shapes of the mold and the U-core 102 are the same. The iron powder is filled into the mold for sintering under the pressure of injection and then shaped into the U-core 102 as shown in FIG. 1C. Since the inverted U-shaped bridges 108A and 108B of the U-core 102 are pretty thin, it fails to support the ends of the sides 110A and 110B. Therefore, the U-core 102 might be out of shape in the sintering process of manufacture. For example, the oblong-shaped sides 110A and 110B of the U-core 102 might be bent outward or bent inward.

Referring to FIG. 2, a structural diagram of a conventional mold for producing the core is shown. The traditional way to solve the aforementioned problem is making a mold shown in FIG. 2. As shown in FIG. 2, the slash part 202 is the filled portion under the bridge 108A and 108B. Utilizing the mold of FIG. 2 to shape up under the pressure of injection, it can produce an iron with the same shape of the mold. Thereafter, it won't result in the iron out of shape during the sintering process due to its firm structure. The sintered iron then proceeds to be polished to become a U-core 102 of FIG. 1C by grinding the slash part 202. However, it is time-consuming for precision grinding and the iron is easily broken. Thus, it cost much to produce the conventional transformer.

SUMMARY OF THE INVENTION

It is therefore an object of the invention to provide a transformer with a simple structure, which is easy to be made. In no need of the step of precision grinding to shape a core, it can raise the yield of the transformer and reduce the production cost.

The invention achieves the above-identified objects by providing a transformer capable of transforming the voltage between a first port and a second port. The transformer includes a bobbin, an I-bar, the first U-core, and the second U-core. The bobbin in a tube shape has the first port and the second port wherein the first port wrapped around by at least one winding of copper coil and the second port wrapped around by at least one winding of copper coil. An I-bar made of high permeable alloy has a first end and a second end. The I-bar is inserted into the bobbin and the first end and the second end of the I-bar protrude outside the tube of the bobbin respectively. A first U-core made of high permeable alloy is placed on one side of the bobbin and has a third end and a fourth end. The third end and the fourth end of the first U-core are placed corresponding to one side of the first end and the second end of the I-bar respectively. A second U-core made of high permeable alloy is placed on the other side of the bobbin and has a fifth end and a sixth end. The fifth end and the sixth end of the second U-core placed corresponding to the other side of the first end and the second end of the I-bar respectively. Moreover, the sunken parts of the first U-core and the second U-core are in opposition to each other.

BRIEF DESCRIPTION OF THE DRAWINGS

Other objects, features, and advantages of the invention will become apparent from the following detailed description of the preferred but non-limiting embodiments. The description is made with reference to the accompanying drawings in which.

DESCRIPTION OF THE PREFERRED EMBODIMENT

Figure 1A:
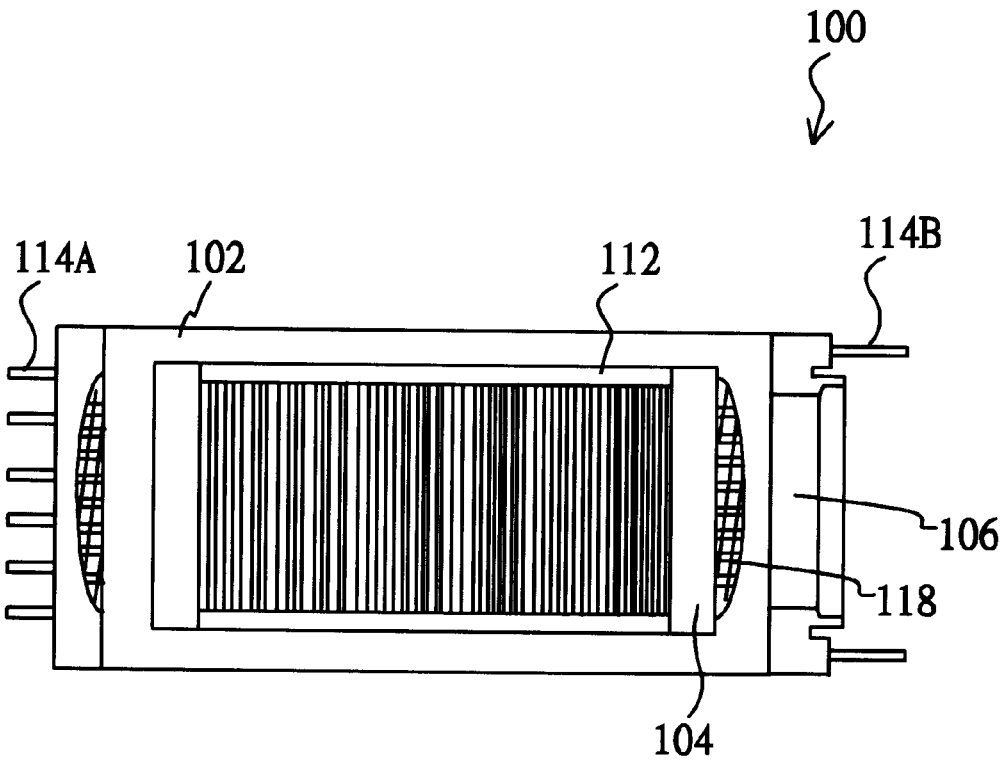
FIG. 1A (Prior Art)
FIG. 1A (Prior Art) shows a top view of a conventional transformer for LCD.
Figure 1B:
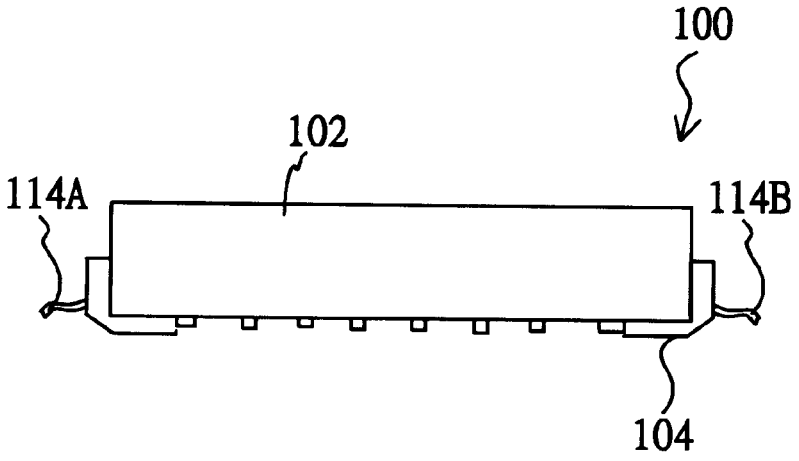
FIG. 1B (Prior Art)
FIG. 1B (Prior Art) shows a lateral view of the conventional transformer for LCD shown in FIG. 1A.
Figure 1C:
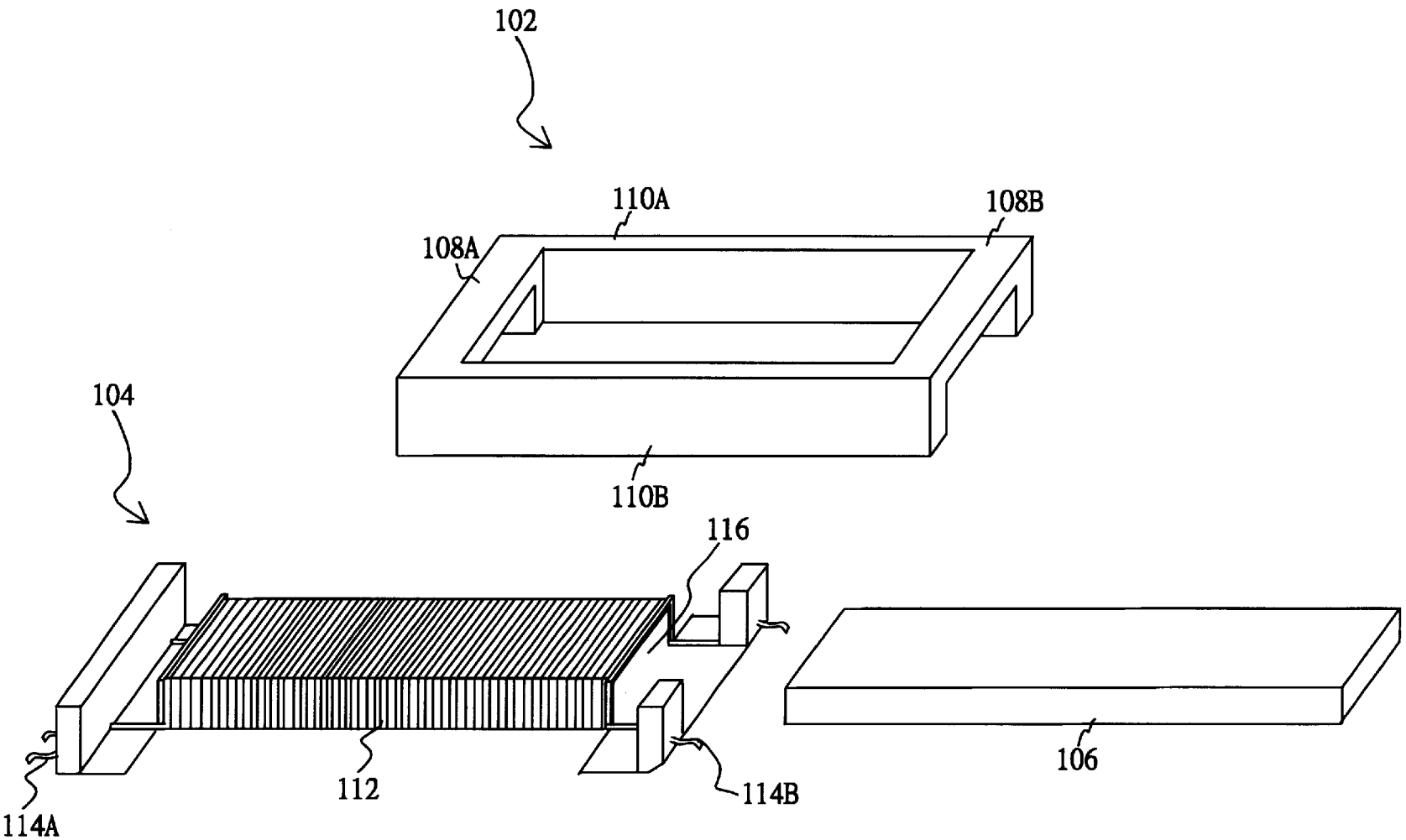
FIG. 1C (Prior Art)
FIG. 1C (Prior Art) shows a decomposed diagram of the conventional transformer for LCD shown in FIG. 1A.
Figure 2:
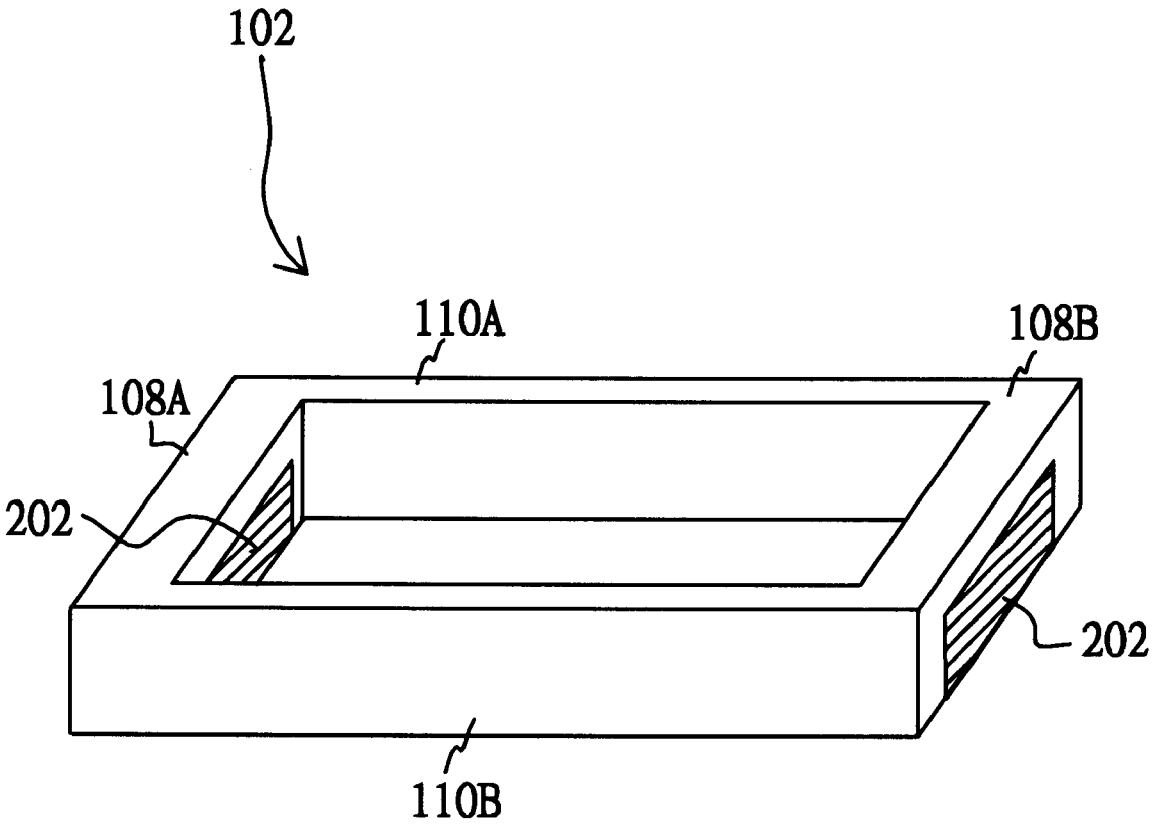
FIG. 2 (Prior Art)
FIG. 2 (Prior Art) shows a structural diagram of a conventional mold for producing the core.
Figure 3A:
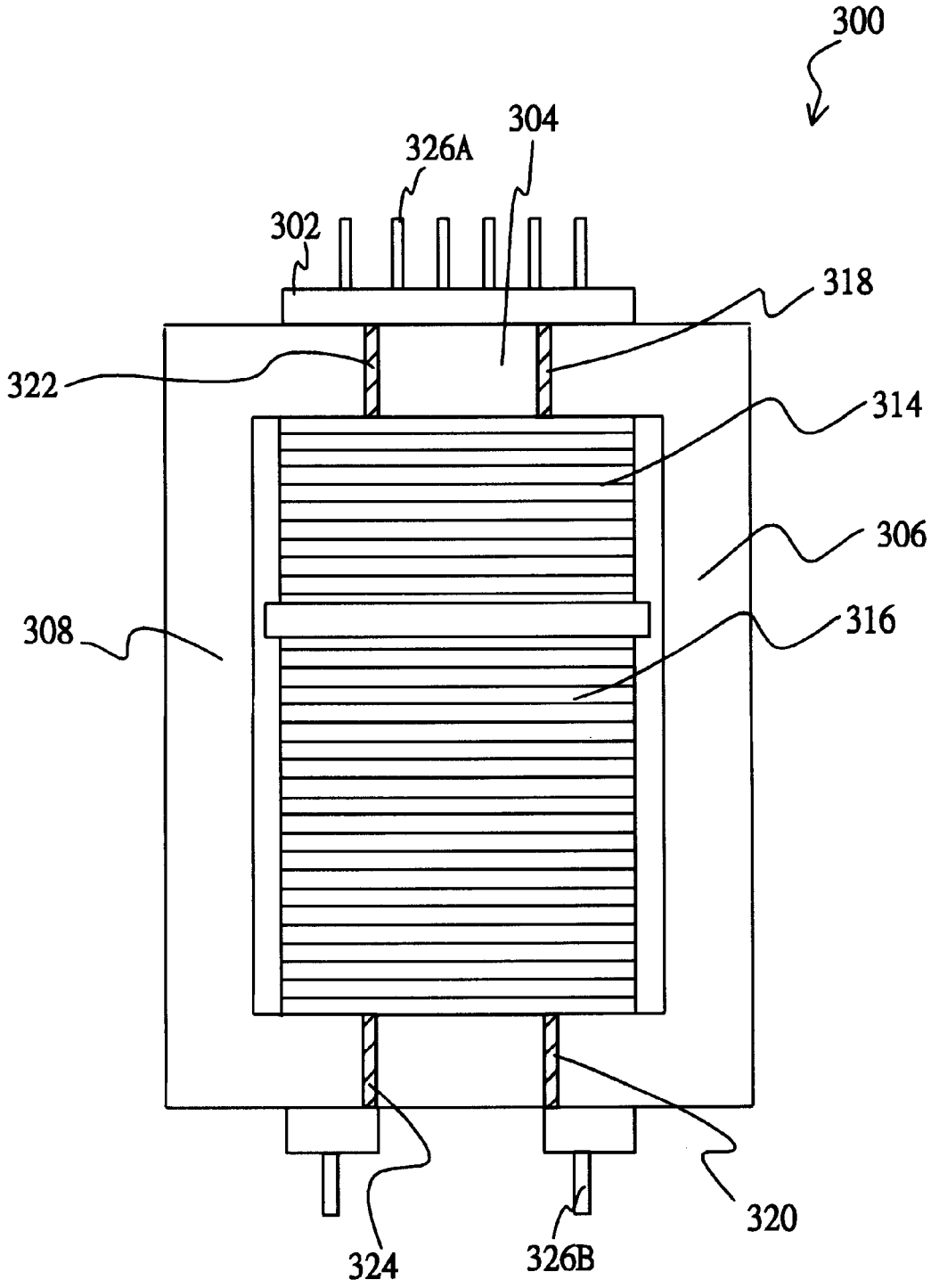
FIG. 3A shows a schematic diagram of the transformer with UI frame according to a preferred embodiment of the invention.
Figure 3B:
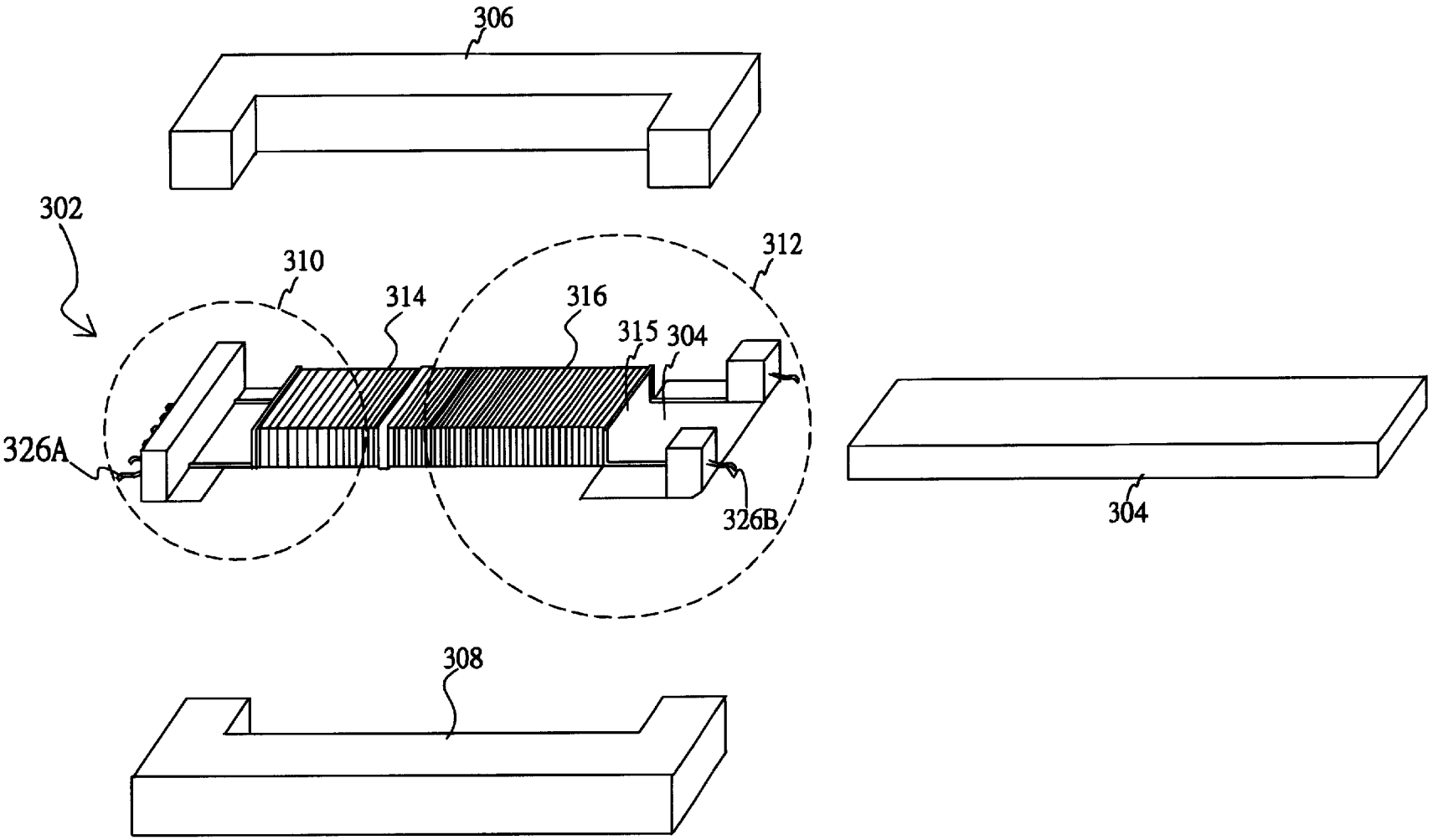
FIG. 3B shows a decomposed diagram of the transformer with UI frame shown in FIG.3A.

Referring to FIGS. 3A–3B, a schematic diagram and a decomposed diagram of the transformer with UI frame according to a preferred embodiment of the invention are shown. The transformer 300 for transforming the voltage between the first port 310 and the second port 312 includes a bobbin 302, the first U-core 306, and the second U-core 308. The bobbin 302 is a plastic tube having the first port and the second port. The first port 310 is wrapped around by M windings of copper coil 314 and the second port 312 is wrapped around by N windings of copper coil 316, wherein the ratio value of the M to N is a constant. The oblong-shaped I-bar 304 made of high permeable alloy of zinc and nickel has a first end and a second end. The I-bar is inserted into the hollow sleeve 315 of the bobbin 302. The first end and the second end of the I-bar 304 protrude outside the tube of the bobbin 32 respectively and thus some parts of the I-bar 304 are not wrapped by the copper coil 314 or 316. The first U-core 306 and the second U-core 308 are both made of high permeable alloy of zinc and nickel. The first U-core 306 is placed on one side of the bobbin 302 and the second U-core 308 is placed on the other side of the bobbin 302. The third end and the fourth end of the first U-core 306 connect to one side of the first end and the second end of the I-bar 304 through the first film 318 and second film 320 respectively. The fifth end and the sixth end of the second U-core 308 connect to the other side of the first end and the second end of the I-bar 304 through the third film 322 and fourth film 324 respectively. Moreover, the sunken parts of the first U-core 306 and the second U-core 308 are in opposition to each other.

The procedure for producing the first U-core 306 and the second U-core 308 is as follows: a mold in circular-rectangle shaped is first opened. The alloy powder is filled into the mold and then a rough core takes shape under the pressure of injection.

After the process of sintering, the rough core shapes into a circular-rectangle shaped core. The circular-rectangle shaped core is cut in the midline thereof and eventually polished to become a pair of U-cores, the first U-core 306 and the second U-core 308.

The underside of the two ends of the bobbin 302 further includes a number of pins 326A and 326B for connecting the terminals of the copper coil 314 and 316 on the bobbin 302 respectively and fixing the transformer on the Printed Circuit Board (not shown in the FIGS.). Furthermore, the film 318, 320, and 324 described above are insulating materials with a fixed thickness, such like mica sheet. The various sensitivities of the transformer come from different thicknesses of the film.

The transformer 300 is assembled by the first U-core 306, second U-core 308, I-bar 304, and the bobbin 302. The procedure of assembling the transformer involves the following steps: the bobbin 302 is first wound with the copper coil 314 on the first port 310 and the copper coil 316 on the second port 312. The two terminals of the copper coil 314 and 316 are then twined round for fastening on the pins 326A and 326B respectively. The I-bar 304 is put into the hollow sleeve 315 of the bobbin 302. Thereafter, the film 318, 320, 322, and ,324 are placed on the surface of the two protruding ends of the first U-core 306 and the second U-core 308. The first U-core 306 and the second U-core 308 are mounted on the two sides of the bobbin 302 and the sunken parts of the first U-core 306 and the second U-core 308 are in opposition to each other. After fixing the first U-core 306, the second U-core 308 and the I-bar 304 together on the bobbin 302 by the epoxy 118, the transformer 300 with the bobbin 302, I-bar 304, the first U-core 306 and the second U-core 308 encompassed is finished.

Referring to FIG. 3, the magnetic circuit formed by the magnetic line of force according to the preferred embodiment of the invention starts from one end of the I-bar 304, passes through the film 318 and 322 and then enters the first U-core 306 and the second U-core 308. The magnetic line of force proceeds along the first U-core 306 and the second U-core 308, passes through the film 320 and 324 and finally enters the other end of the I-bar 304.

The feature of the manufacturing process according to this invention as compared to the conventional one is without the step of precision grinding after sintering. Since the cores are pretty thin and easily broken during the precision grinding, it is time-consuming and costs much to produce a transformer conventionally. It can raise the yield of the transformer and shorten the time for production.

The first U-core 306 and the second U-core 308 with simple structures are easy to be made. It only requires one mold to produce the first U-core 306 and the second U-core 308 at one time and thus reduces the production cost. Therefore, the transformer according to this invention possesses of predominance in the market.

While the invention of the transformer has been described by way of example and in terms of the preferred embodiment, it is to be understood that the invention is not limited to the disclosed embodiment. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A transformer capable of transforming the voltage between a first port and a second port comprising:

a bobbin in a tube shape having the first port and the second port thereon, wherein the first port is wrapped around by at least one first winding of copper coil and the second port is wrapped around by at least one second winding of copper coil;

an I-bar having a first end and a second end inserted into the tube of the bobbin, wherein the first end of the I-bar and the second end of the I-bar protrude outside the tube of the bobbin;

a first U-core having a third end and a fourth end, placed on a first side of the bobbin, wherein the third end of the first U-core is coupled to the first end of the I-bar and the fourth end of the first U-core is coupled to the second end of the I-bar; and a second U-core having a fifth end and a sixth end, placed on a second-side of the bobbin opposite to the first side of the bobbin, wherein the fifth end of the second U-core is coupled to the first end of the I-bar and the sixth end of the second U-core is coupled to the second end of the I-bar.

2. The transformer according to claim 1 wherein the method of producing the first U-core and the second U-core comprising the steps of:

(a) taking shape under the pressure of injection and sintering a circular-rectangle shaped core; and (b) cutting the circular-rectangle shaped core in the midline thereof and finishing the first U-core and the second U-core.

3. The transformer according to claim 1 wherein the bobbin is made of plastic.

4. The transformer according to claim 1, wherein the bobbin further comprises a plurality of pins for connecting the at least one first winding of copper coil on the first port and the at least one second winding of copper coil on the second port.

5. The transformer according to claim 1, wherein the third end of the first U-core and the first end of the I-bar are coupled through a first film, and the fourth end of the first U-core and the second end of the I-bar are coupled through a second film.

6. The transformer according to claim 5, wherein the fifth end of the second U-core and the first end of the I-bar are coupled through a third film, and the sixth end of the second U-core and the second end of the I-bar are coupled through a fourth film.

7. The transformer according to claim 6 wherein the first film, second film, third film, and fourth firm are mica sheet.

8. The transformer according to claim 1 wherein the I-bar is a flat rectangular solid.

9. The transformer according to claim 1 wherein the I-bar is made of permeable alloy.

10. The transformer according to claim 9 wherein the I-bar is made of high permeable alloy of zinc and nickel.

11. The transformer according to claim 1 wherein the first U-core and the second U-core are made of permeable alloy.

12. The transformer according to claim 11 wherein the first U-core and the second U-core are made of high permeable alloy of zinc and nickel.

* * * * *